US009808130B2

(12) United States Patent
Bank et al.

(10) Patent No.: US 9,808,130 B2
(45) **Date of Patent: *Nov. 7, 2017**

(54) PERSONAL CLEANING SYSTEM

(71) Applicant: Tactopack, Inc., Pelham, NY (US)

(72) Inventors: Steven Bank, Pelham, NY (US); Jonathan D. Albert, Philadelphia, PA (US); Chris Murray, Philadelphia, PA (US); Breanna Stachowski, Philadelphia, PA (US)

(73) Assignee: TACTOPACK, INC., Pelham, NY (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/084,174

(22) Filed: Mar. 29, 2016

(65) Prior Publication Data

US 2016/0287032 A1 Oct. 6, 2016

Related U.S. Application Data

(63) Continuation of application No. 14/677,532, filed on Apr. 2, 2015, now Pat. No. 9,326,645.

(51) Int. Cl.
*A47K 7/03* (2006.01)

(52) U.S. Cl.
CPC ..... *A47K 7/03* (2013.01)

(58) Field of Classification Search
CPC ..... A47K 7/03; A47L 13/19; A46B 5/04
USPC ..... 401/6–8, 185, 186, 188 R
See application file for complete search history.

(56) References Cited

U.S. PATENT DOCUMENTS

| | | | |
|---|---|---|---|
| 19,188 | A | 1/1858 | Evans |
| 674,913 | A | 5/1901 | Fike |
| 685,574 | A | 10/1901 | Conboie |
| 722,863 | A | 3/1903 | Lodge |
| 836,181 | A | 11/1906 | Cray |
| 1,161,719 | A | 11/1915 | Norton |
| 1,438,485 | A | 12/1922 | Goldberg |
| 1,481,772 | A | 1/1924 | Zell |
| 1,533,732 | A | 4/1925 | Livingstone |
| 1,558,930 | A | 10/1925 | Schuck |
| 1,619,180 | A | 3/1927 | Andrew |
| 1,713,065 | A | 5/1929 | Williams |
| 1,941,320 | A | 12/1933 | Pamplin |
| 2,075,413 | A | 3/1937 | Logue |
| 2,405,154 | A | 8/1946 | Logan |

(Continued)

FOREIGN PATENT DOCUMENTS

| | | | |
|---|---|---|---|
| CH | 303374 | A | 11/1954 |
| EP | 2676544 | A1 | 12/2013 |

(Continued)

*Primary Examiner* — Jennifer C Chiang
*Assistant Examiner* — Bradley Oliver
(74) *Attorney, Agent, or Firm* — Leason Ellis LLP

(57) ABSTRACT

The invention describes a cleaning system in the form of a mitt having cleaning pads attached by reversible fastening means so that pads may be electively and consecutively attached, removed, or replaced. Furthermore, the invention provides a means for introducing, retaining, dispensing, and distributing a fluid, such as water or a liquid cleaning product, so that a removable pad may be irrigated with a regulated dose of fluid prior to use. The invention also describes a cooperative enclosure that can store a plurality of cleaning pads. Features of the compatible enclosure serve to physically guide the body of the mitt into alignment with a replacement pad.

23 Claims, 13 Drawing Sheets

(56) References Cited

U.S. PATENT DOCUMENTS

| | | | |
|---|---|---|---|
| 2,562,418 | A | 7/1951 | Enrico et al. |
| 2,651,071 | A | 9/1953 | Frances et al. |
| 2,722,706 | A | 11/1955 | Joan |
| 2,795,806 | A | 6/1957 | Omar |
| 2,831,206 | A | 4/1958 | Curtis |
| 3,116,732 | A | 1/1964 | Cahill |
| 3,485,562 | A | 12/1969 | Hidden et al. |
| 3,589,819 | A | 6/1971 | Bryant |
| 3,701,604 | A | 10/1972 | Holroyd |
| 3,778,172 | A | 12/1973 | Myren |
| 3,883,897 | A | 5/1975 | Lefkowitz et al. |
| 3,885,249 | A | 5/1975 | De Brabander |
| 4,037,790 | A | 7/1977 | Reiser et al. |
| 4,457,640 | A | 7/1984 | Anderson |
| 4,602,650 | A | 7/1986 | Pipkin |
| 4,645,251 | A | 2/1987 | Jacobs |
| 4,766,914 | A | 8/1988 | Briggs |
| 4,959,881 | A | 10/1990 | Murray |
| 5,094,559 | A | 3/1992 | Rivera et al. |
| 5,111,934 | A | 5/1992 | Morin |
| 5,120,304 | A | 6/1992 | Sasaki |
| 5,169,251 | A | 12/1992 | Davis |
| 5,441,355 | A | 8/1995 | Moore |
| 5,456,354 | A | 10/1995 | Wood |
| 5,473,789 | A | 12/1995 | Oster |
| 5,542,566 | A | 8/1996 | Glaug et al. |
| 5,722,349 | A | 3/1998 | Wolgamuth |
| 5,867,829 | A | 2/1999 | Hegoas et al. |
| 5,947,275 | A | 9/1999 | Hess |
| 5,956,770 | A | 9/1999 | Dennis |
| 6,098,234 | A | 8/2000 | Jackson, Jr. |
| 6,145,155 | A | 11/2000 | James et al. |
| 6,257,785 | B1 | 7/2001 | Otten |
| 6,305,044 | B1 | 10/2001 | James et al. |
| 6,508,602 | B1 | 1/2003 | Gruenbacher et al. |
| 6,513,998 | B1 | 2/2003 | Barry |
| 6,539,549 | B1 | 4/2003 | Peters, Jr. |
| 6,547,468 | B2 | 4/2003 | Gruenbacher et al. |
| 6,588,961 | B2 | 7/2003 | Lafosse-marin et al. |
| 6,604,244 | B1 | 8/2003 | Leach |
| 6,669,387 | B2 | 12/2003 | Gruenbacher et al. |
| 6,726,386 | B1 | 4/2004 | Gruenbacher et al. |
| 6,811,338 | B1 | 11/2004 | Manske Jr. |
| 6,817,801 | B1 | 11/2004 | Colburn et al. |
| 6,834,619 | B1 | 12/2004 | Rampersad |
| 7,021,848 | B1 | 4/2006 | Gruenbacher et al. |
| 7,033,100 | B2 | 4/2006 | Barton et al. |
| 7,108,440 | B1 | 9/2006 | Gruenbacher et al. |
| 7,179,007 | B2 | 2/2007 | Wong et al. |
| 7,255,506 | B2 | 8/2007 | Gruenbacher et al. |
| 7,478,768 | B2 | 1/2009 | Yip |
| 7,604,623 | B2 | 10/2009 | Brunner et al. |
| 7,730,574 | B1 | 6/2010 | Cox, Sr. |
| 7,731,056 | B2 | 6/2010 | Tramontina |
| 7,823,245 | B2 | 11/2010 | Firouzman |
| 7,874,020 | B1 | 1/2011 | Franklin |
| 7,904,969 | B2 | 3/2011 | Greenfield |
| 8,061,558 | B2 | 11/2011 | Jordan et al. |
| 8,069,526 | B2 | 12/2011 | Malaska |
| 8,167,177 | B1 | 5/2012 | Galgano |
| 8,230,523 | B2 | 7/2012 | Chareyron |
| 8,262,305 | B2 | 9/2012 | Lam et al. |
| 8,356,378 | B1 | 1/2013 | Crooms |
| 8,661,601 | B2 | 3/2014 | Klingbeil |
| 8,689,387 | B2 | 4/2014 | Gundersen |
| 8,794,189 | B1 | 8/2014 | Dahlquist et al. |
| 8,826,467 | B2 | 9/2014 | Chew et al. |
| 2005/0217045 | A1 | 10/2005 | Minkler et al. |
| 2006/0288954 | A1 | 12/2006 | Graunstadt |
| 2007/0094766 | A1 | 5/2007 | Liu |
| 2007/0130707 | A1 | 6/2007 | Cohen et al. |
| 2007/0192975 | A1 | 8/2007 | Aseff |
| 2007/0206984 | A1 | 9/2007 | Fagel et al. |
| 2008/0078046 | A1 | 4/2008 | Reed |
| 2008/0276395 | A1 | 11/2008 | Powell et al. |
| 2010/0037413 | A1 | 2/2010 | Tyler |
| 2010/0218326 | A1 | 9/2010 | Yamaguchi |
| 2010/0257681 | A1 | 10/2010 | Lin |
| 2011/0113528 | A1 | 5/2011 | Chew et al. |
| 2011/0240760 | A1 | 10/2011 | Tucker |
| 2011/0274377 | A1 | 11/2011 | Lin |
| 2012/0090121 | A1 | 4/2012 | Phillips, Sr. et al. |
| 2012/0189371 | A1 | 7/2012 | Morelli |
| 2013/0341212 | A1 | 12/2013 | Perelli |

FOREIGN PATENT DOCUMENTS

| | | | |
|---|---|---|---|
| FR | 1127965 | A | 12/1956 |
| FR | 1539481 | A | 9/1968 |
| GB | 924503 | A | 4/1963 |
| JP | 2001269222 | A | 10/2001 |
| WO | WO 2006120330 | | 11/2006 |
| WO | WO 2007122594 | | 11/2007 |
| WO | WO 2008096135 | | 8/2008 |

PERSONAL CLEANING SYSTEM

CROSS-REFERENCE TO RELATED PATENT APPLICATIONS

This application is a continuation of U.S. Non-Provisional patent application Ser. No. 14/677,532, filed Apr. 2, 2015, the entire contents of which is incorporated by reference herein as if expressly set forth in its respective entirety herein.

TECHNICAL FIELD

The present invention relates to the area of products used in the act of personal cleaning. It also relates to the area of mitts or gloves used in a cleaning process. More particularly, it relates to hand-worn articles in which a material is supplied in a fluid state to assist in a cleaning operation. The present invention additionally relates to the packaging, display, and storage of such articles.

BACKGROUND

The convenience of combining a hand-mounted device with a brushing, cleaning, wiping, polishing, or material application function may be generally appreciated as such wearable products free the user from the necessity of actively gripping a cloth, sponge, or other loose material.

A number of attempts have been made to produce such hand-mounted devices. For example, U.S. Pat. No. 19,188 to Evans shows a flexible hand-mounted curry comb for use in the grooming of livestock. U.S. Pat. No. 674,913 to Fike shows a hand-mounted glove with an internal pocket devised to hold soap or medicated material, so that the glove may be dipped in water to activate the enclosed material. U.S. Pat. No. 722,863 to Lodge discloses a cleaning mitt in which a stack of facing layers may be successively exposed.

U.S. Pat. No. 836,181 to Cray reveals a washing glove with an external fluid supply line and an integral fluid reservoir. U.S. Pat. No. 1,161,719 to Norton details a hand-worn device with integrated, perforated reservoirs from which fluid materials may be actively and electively expressed. U.S. Pat. No. 3,116,732 to Cahill describes a disposable glove with rupturable reservoirs carrying lotion, liquid or balm. U.S. Pat. No. 4,959,881 to Murray provides for a disposable cleaning mitt with an initially sealed container holding a pad permeated with a cleaning solution.

U.S. Pat. No. 3,778,172 to Myren illustrates a cleaning glove with a reservoir refillable through a valve. U.S. Pat. No. 5,169,251 to Davis shows a hand-worn dispenser with fingertip applicators that may be individually opened or capped to regulate the dispensing pattern. U.S. Pat. No. 6,145,155 discloses a sealed disposable mitt with a moistened face and a drying face. U.S. Pat. No. 6,257,785 to Otten et al. depicts a glove with a plurality of individual reservoirs arranged in a dimpled relief pattern so that a degree of user control is allowed over the amount and location of the encapsulated agent that is released.

By reference to the examples above, it may be generally understood that there has been a longstanding interest in systems which integrate a hand-worn article with consumable cleaning materials. It may also be appreciated that the inclusion of a fluid carrier within a hand-worn article, whether for water of other liquid formulation, can enhance the utility and convenience of such a device.

SUMMARY

The present invention according to one embodiment describes a portable cleaning system that can be employed in situations where other means of personal cleansing are unsanitary, inconvenient or inaccessible. The system of the invention includes diverse features and modes of operation directed to the comfortable and convenient use of a conscientiously devised mitt. The following exemplary cleaning mitt system can also be provided as a kit which includes what may be viewed as three discrete operational components. The kit is strategically and ergonomically devised so that it can be distributed on shelves at retain establishments. In the presently disclosed embodiment of the invention, these three components are those handled separately by the consumer.

The first component is a mitt possessing a layered structure. The mitt integrates a fluid reservoir and a pump subassembly that may be activated by the user to regulate the allocation of fluid. The pump is conscientiously devised to present a low profile, both for compactness of packaging and for comfort during use. The second component is a wettable cleaning pad temporarily attached by reversible fastening means to the face of the mitt. The third component is a storage enclosure and alignment guide in which the mitt and a plurality of pads may be housed.

The enclosure typically carries a mitt with a fluid-filled reservoir that is in communication with the pump subassembly. The enclosure also includes a stack of disposable pads. The mitt and the pads may be stored in the same stack within the enclosure.

In the operation of the cleaning system of the invention, one pad is reversibly attached to the front face of the mitt. Fluid is then pumped from the reservoir and dispensed to the mounted pad via the pump subassembly. The user may elect the amount of fluid delivered to the pad by successive activation of a displaceable interface, such as a deformable bulb or membrane. The design and positioning of the pump allow the user to activate the pump by pressing bulb against any convenient resistant surface.

The moistened pad mounted on the front face of the mitt can then be used to perform any suitable cleaning action. The system therefore provides portable, convenient personal care in a form well adapted to many professional practices and recreational activities. In other words, the system can be easily transported.

BRIEF DESCRIPTION OF THE DRAWING FIGURES

Additional features of the invention will become evident in the following detailed description of a system formed in accordance with the invention, in which.

Figure 11:
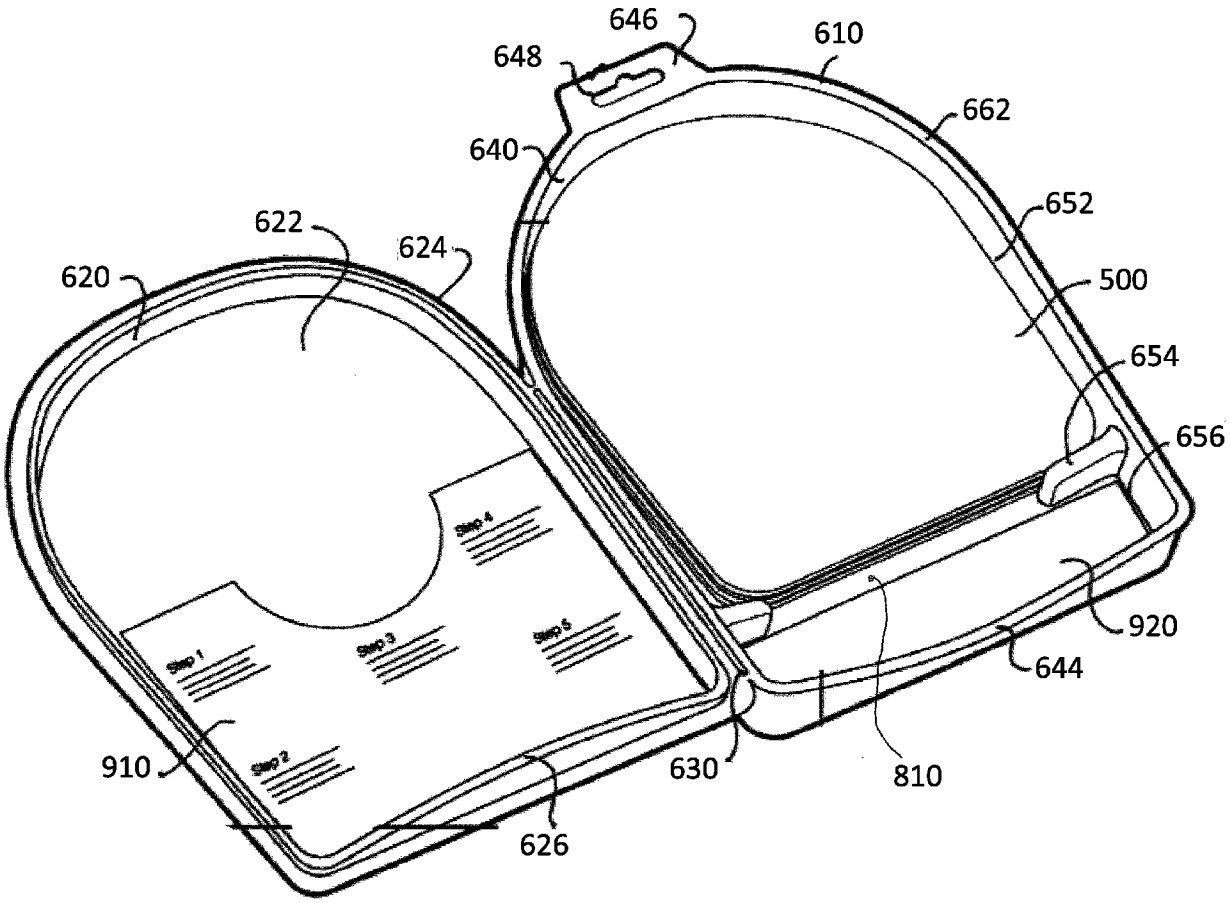
Figure 12:
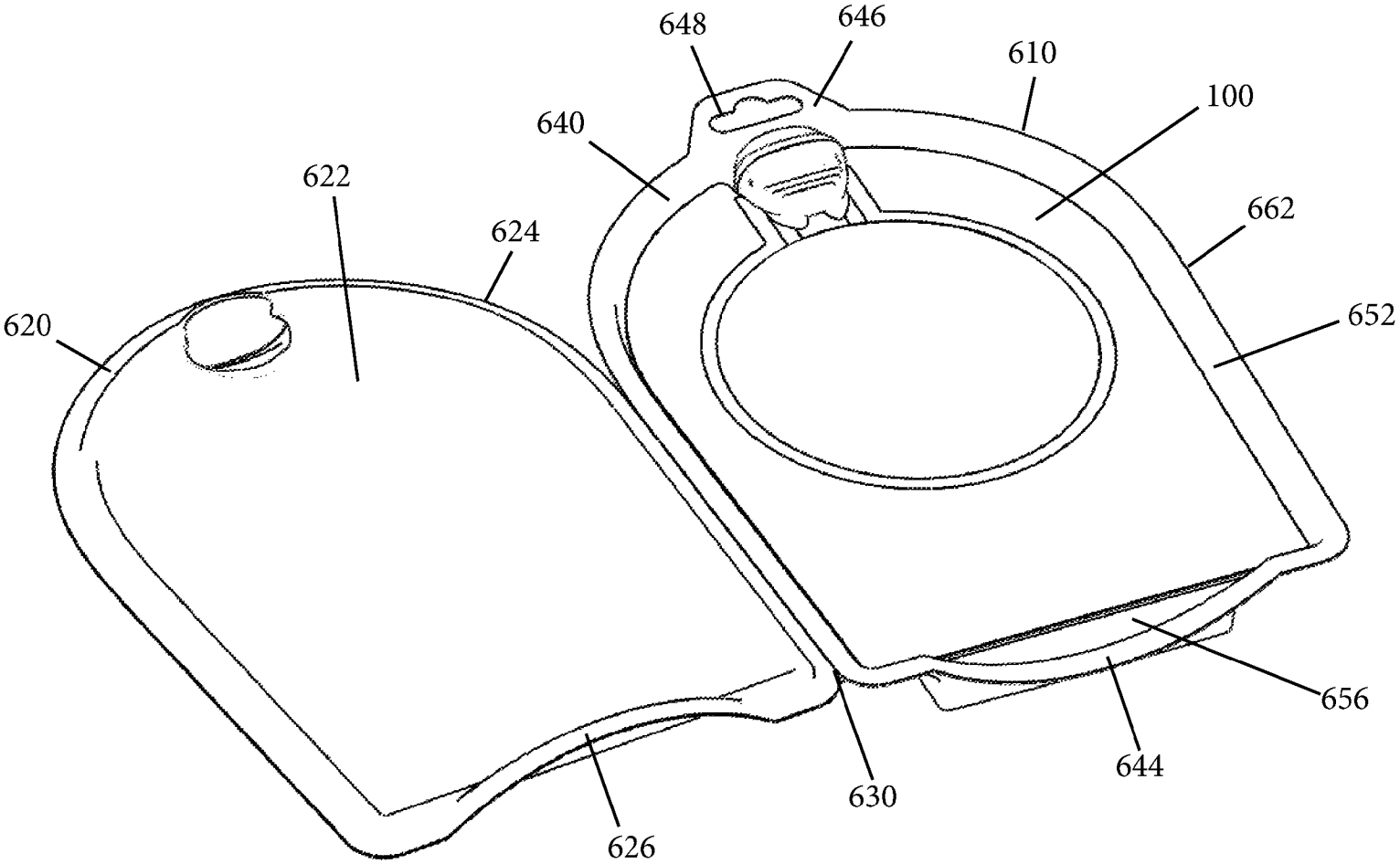

FIG. 11 is a second perspective view of the hinged enclosure formed according to the invention, showing a stack of pads in place to demonstrate the storage and alignment features of the enclosure; and FIG. 12 is a third perspective view of an empty, hinged enclosure formed according to the invention, showing how the mitt is placed in the container when the user is mounting a pad onto the face of the mitt.

DETAILED DESCRIPTION OF CERTAIN EMBODIMENTS OF THE INVENTION

The present invention discloses a cleaning system which includes a mitt or glove into which the hand is inserted. The back side of the mitt structure includes a pouch comprising at least two layers of impermeable material so that a fluid reservoir may be provided at a location corresponding to the back of the hand. A pump subassembly, which is devised to momentarily capture a metered amount of fluid from the reservoir, is located in an unobtrusive location, such as the apex of the mitt. The apex is colloquially defined in this specification as the region just beyond the anticipated location of the middle finger when the hand is fully entered into the mitt.

A front panel, which can also be impermeable, is bonded to the pouch along the common perimeter of the two subassemblies. The bond does not encompass the entire perimeter, as an opening is necessarily left for the introduction of the user's hand. In the illustrated embodiment, the mitt component displays substantial bilateral symmetry along its medial axis, so that the mitt has an interior pocket shaped so that either hand may be comfortably inserted.

The pocket which receives the hand is therefore located between two constructions of sheet material that may be expected to differ in form and composition. The pouch and the front panel nevertheless have coincident contours about at least a part of their perimeters so that a bond may be formed along a suitable length of their shared outer edge profiles. The back-side pouch and the front panel are permanently joined, for example by thermal welding or other suitable techniques, to form the hand-receiving pocket of the mitt.

In its functional state, the back-side pouch, devised to be positioned over the back of the hand, comprises a substantially enclosed fluid-containing reservoir that remains functionally separate from the pocket into which the hand is inserted. The reservoir may occupy a region that is limited to an area inset from a large part of the outer perimeter of the pouch.

Laminated stock commonly used in the soft packaging of fluids often includes a heat-sealable polymer layer on one face. This allows the material to form a hygienic sealed enclosure when the stock is fused to itself, or to another compatible material.

The structural configuration described above, in which the reservoir is inset from much of the perimeter, allows the inner panel of the pouch to be fused to the outer panel, while leaving a margin of fusible surface to be left so that a further assembly may occur. In the illustrated embodiment of the invention, this margin is employed to bond the pouch to the front panel of the mitt.

These sealing operations may be performed locally in such a way that an opening is left in the enclosed pouch volume. This may occur at an elongate neck that has fluid access to the reservoir.

At the location of this opening, a sealable filling port may be provided to allow a temporary fluid inlet to the reservoir. The reservoir can be filled any time after the pouch has been formed, which may be either before or after the front panel of the mitt has been attached.

The front panel, devised to be located over the palm side of the hand, can be compatibly devised of a closed cell foam material that is substantially impermeable to the fluid held in the reservoir. The external face of the front panel is provided with reversible attachment means for the intermittent (selective) use of the disposable cleaning pads. The attachment means may include, for example, regions bearing arrays of hooked structures. These hooked structures can be carried upon a prefabricated tape or fabric that is permanently affixed to the external face of the front panel.

The disposable cleaning pads have an internal side and an external side. The internal side may compatibly include looped textures that engage with the hooked regions so that a secure but temporary connection may be made between the external side of the mitt face and the internal side of the cleaning pad. The looped property can be intrinsic to one face of a nonwoven sheet material used in the makeup of the pad. In other words, a hook and loop type mechanical coupling can be used to releasably secure the cleaning pad to the external face of the front panel.

A pump subassembly is disposed intermediate between the back-side reservoir and the external face of the mitt. The pump subassembly is attached to the pouch in such a way that selective fluid communication is allowed between the substantially enclosed reservoir of fluid within the pouch and at least one port accessing the face of the mitt. In the invention, the pump subassembly includes a displaceable interface, such as a deformable elastic membrane, so that a user may actively dispense fluid to the external face of the mitt, or, more comprehensively, between the external face of the mitt and a mounted disposable cleaning pad.

The system of the present invention can also encompass a cooperatively designed enclosure which can be used to carry a mitt and a set of pads. The enclosure can usefully include an internally concave conforming surface having an external wall only slightly greater in extent than the perimeter of the disposable pads. A wall of the enclosure can also include an indentation anticipating the placement of a user's wrist.

After use, the soiled pad can be removed and replaced with a fresh pad. The soiled pad may be immediately discarded. However, it is also envisioned that the soiled pad may be returned to the enclosure, but kept apart from the clean pads by an impermeable separator of a shape similar to that of the pad itself. This feature is advantageous, for example, when the user is in a remote environment where an appropriate disposal method may not be readily available.

Figure 1A:
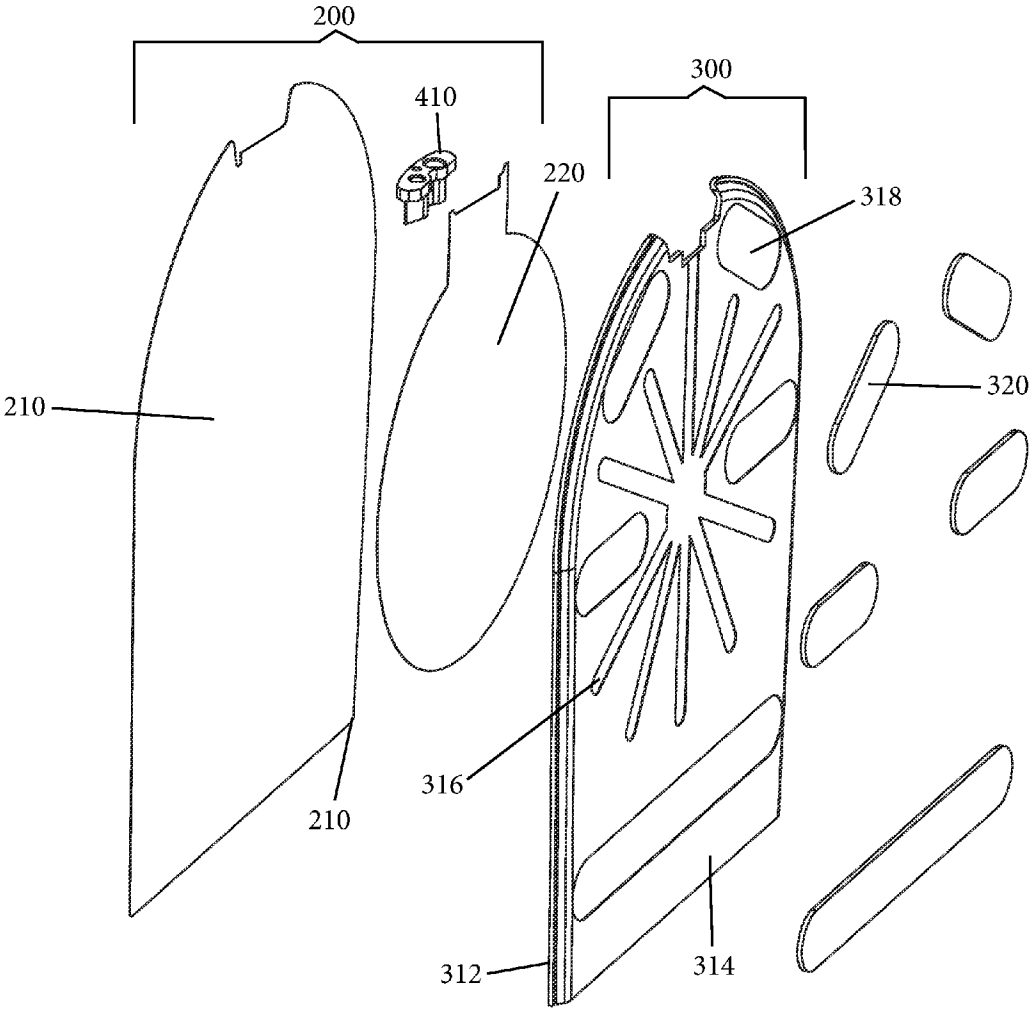
FIG. 1A is a front exploded perspective view of the pouch subassembly, and the front panel assembly of the mitt along with a portion of the pump subassembly.
Figure 1B:
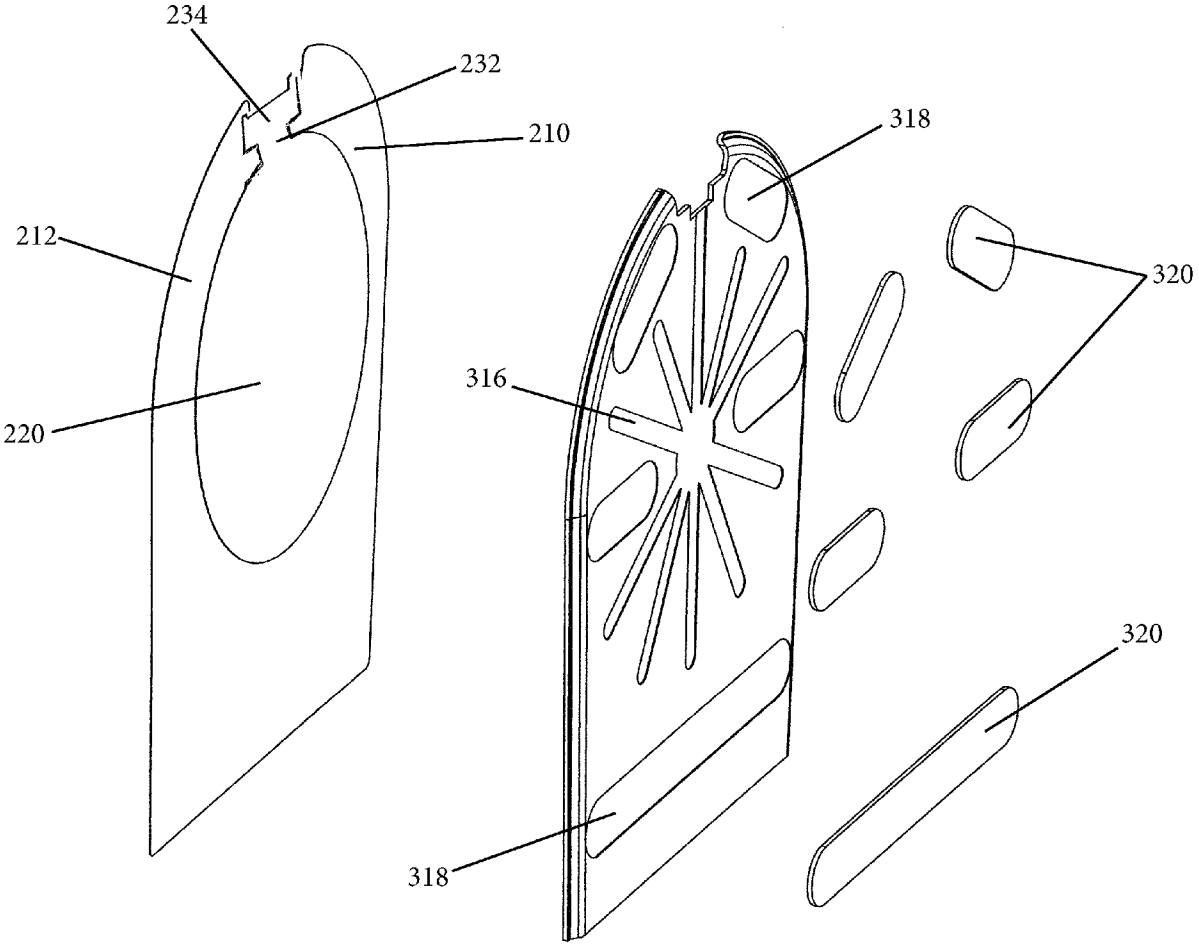
FIG. 1B is a front exploded perspective view of the pouch subassembly, showing the formation of the fluid reservoir.
Figure 2:
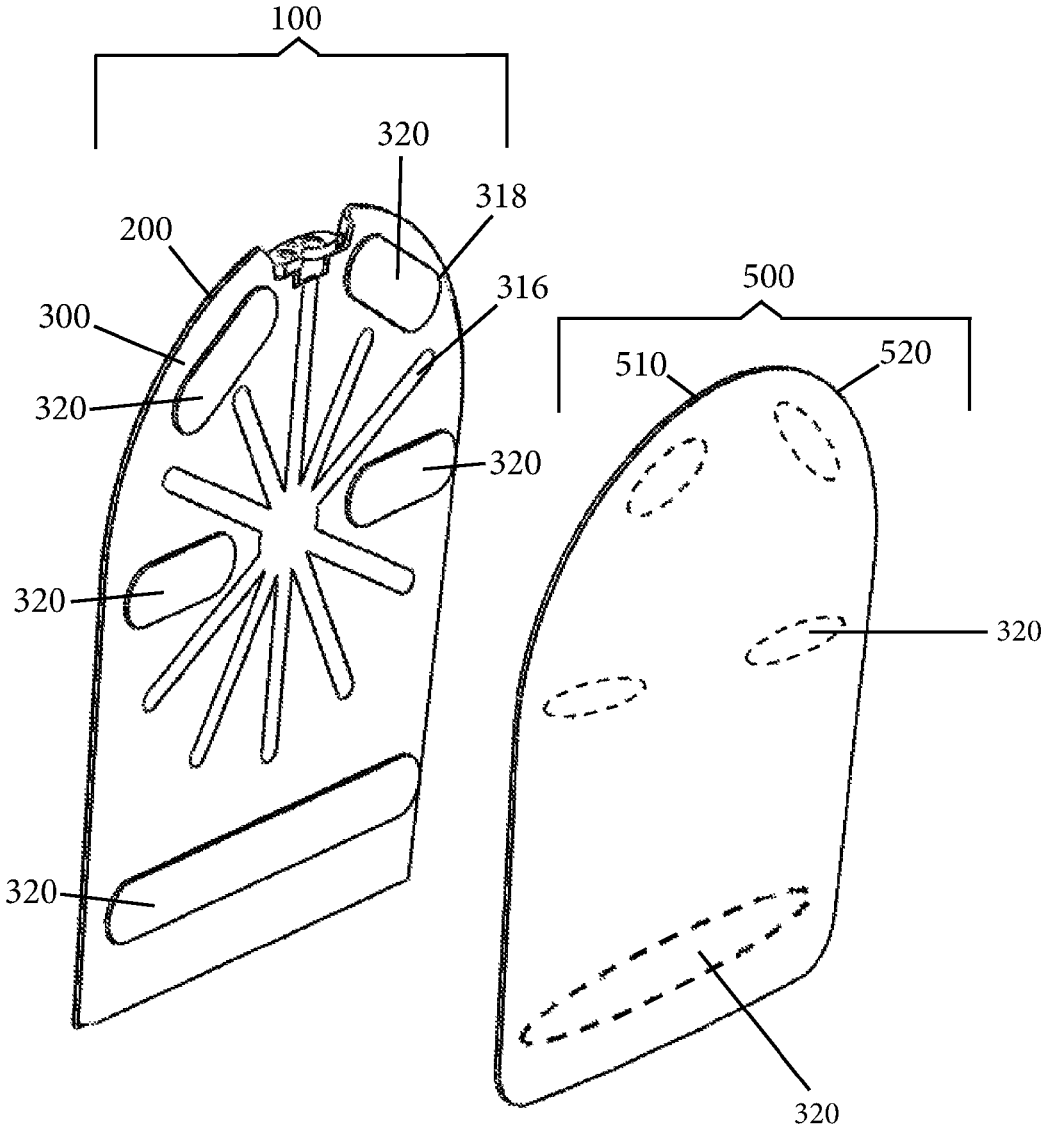
FIG. 2 is a front exploded perspective view of the pouch, front panel, and pump components joined to form the mitt assembly and showing the relative position of a pad.

The perspective views of FIGS. 1A, 1B, and 2 generally describe mitt assembly 100, which includes three subassemblies according to one embodiment. In the following discussion, further reference may be made to the plan views of the mitt in FIGS. 3, 4 and 5. Two subassemblies form a mitt between which the user's hand is ultimately inserted, and a third provides an intermediate pump for fluid. It will be understood that the construction of the system using the subassemblies disclosed herein is merely exemplary in nature and other constructions including other sub-assemblies and combinations thereof can be used.

More specifically, pouch subassembly 200 typically includes the elements that retain the cleaning fluid, while front panel subassembly 300 typically includes an impermeable, resilient face to which fluid may be dispensed, and onto which fluid-permeable pads may be attached. The third subassembly, pump subassembly 400, provides a means to covey (transport) fluid from the back reservoir to the front panel in a regulated manner. The details of the pump subassembly are best understood by reference to FIGS. 6, 7, and 8.

Figure 3:
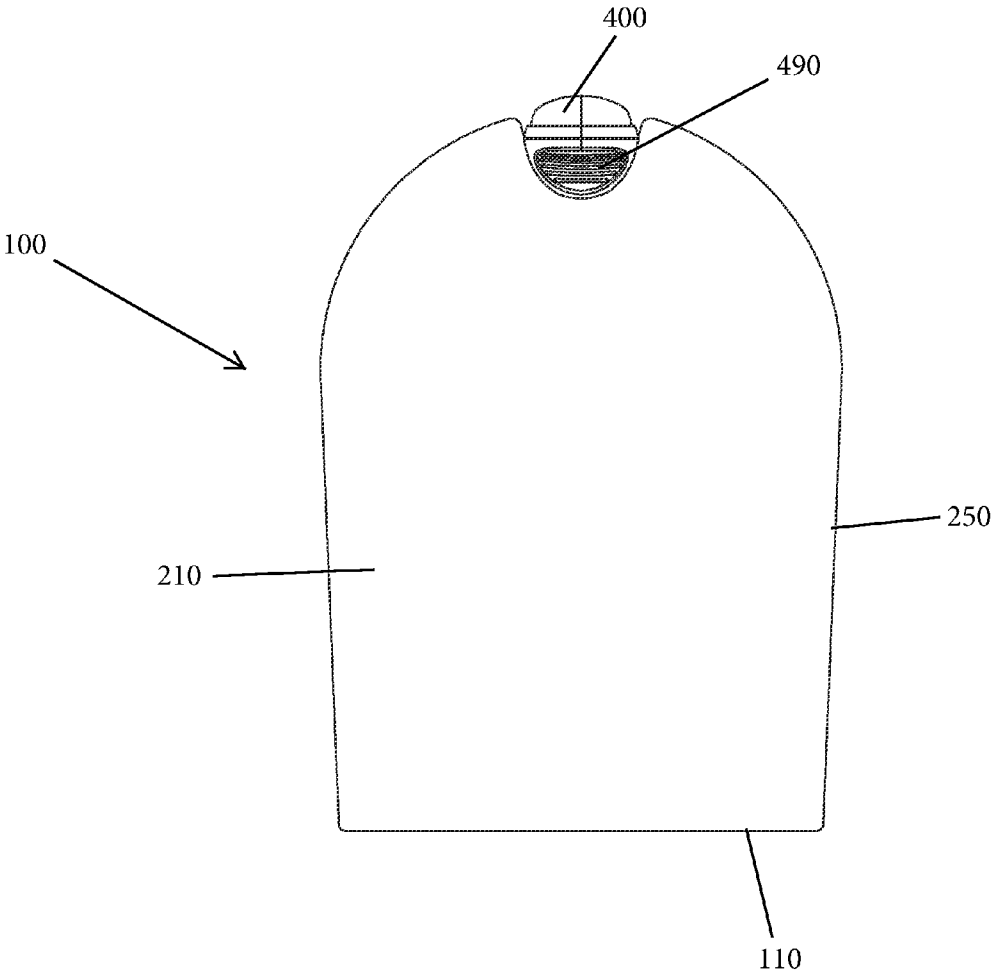
FIG. 3 is a plan view of the completed mitt assembly showing the back face of the back-side pouch, and showing the location of the fluid reservoir.
Figure 4:
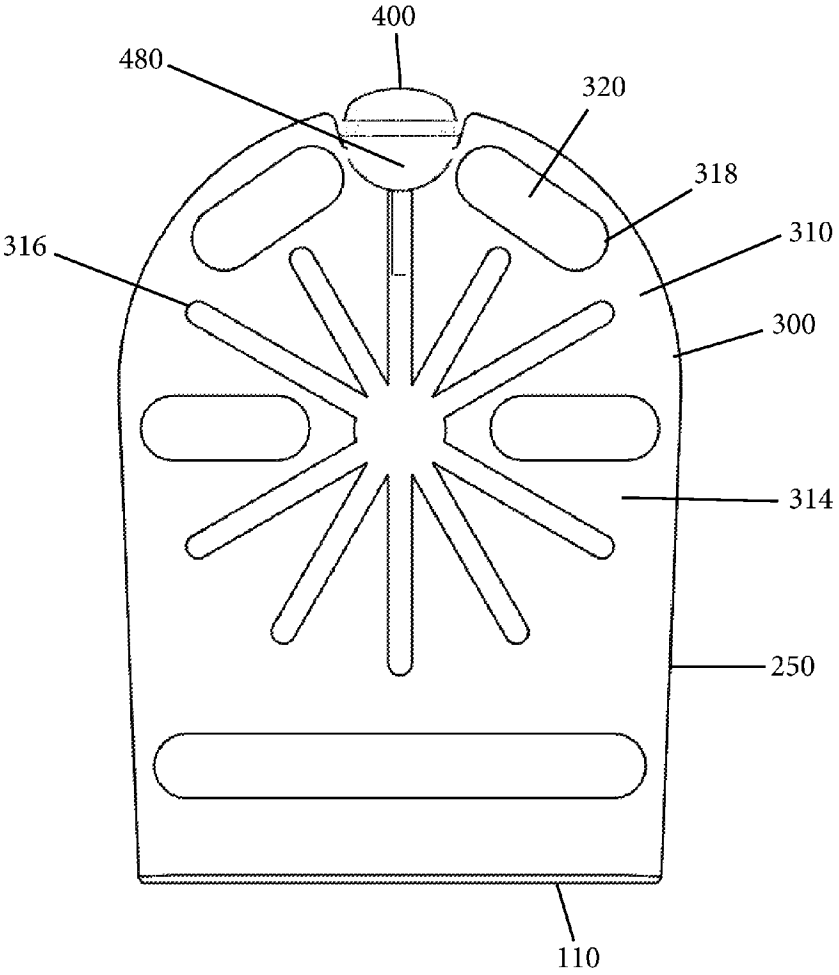
FIG. 4 is a plan view of the completed mitt assembly showing the external face of the front panel.

It will be understood by reference to FIGS. 1A, 1B, and 3 that the pouch is integrated into the structure of the mitt such that it may reliably retain a supply of fluid. The pouch is therefore typically made of materials selected to be substantially impermeable to the anticipated fluid supply. The selection of the pouch material may depend upon the elected fluid formulation. In any event, the pouch holds the fluid to be dispensed.

Materials for the fabrication of pouches, packs, bags, or other flexible, sealed fluid-carrying containers are widely available for the packaging of drinks, foodstuffs, condiments, cosmetics, pharmaceuticals, and medical supplies. These commonly include an outer polymer layer, and intermediate foil layer, and an inner polymer layer having a lower melting point than the polymer used in the outer layer. These layers can be laminated using an adhesive, or by heat and pressure.

Once laminated into a multi-ply film, such materials can be assembled into inexpensive, relatively unbreakable vessels by placing the inner surfaces in a facing relationship, and locally heating a perimeter while applying pressure.

Polyester (PET) is often used as an outer layer. PET provides strength and has a high melting point. Ink may electively be reverse-printed in one or more steps on the inside of this PET layer. Oriented polypropylene (OPP) may also be used. When printing is performed on internal surfaces prior to lamination, the printing is captured under a transparent film layer in such a way that condensation and handling do not mar the imagery.

Foil is often used as an internal barrier, either as discrete foil layer, or as a thin foil vacuum metallized onto an intermediate film layer such as polyester (MPET). Foil is an effective barrier to oxygen, evaporation, and light. Other intermediate-layer barrier materials include Saran coated Polyester (KPET), and ethylene vinyl alcohol copolymer (EVOH).

Linear low-density polyethylene (LLDPE) often constitutes the fusible inner layer. LLDPE provides an additional moisture barrier, and has a relatively low melting point. Amorphous poly-alpha-olefins (APAO) may also be suitable for the inner fusible layer. Regardless of its exact composition, it is this innermost layer that is locally melted in the process of forming a heat-welded seal, seam, or joint.

The pouch subassembly may be formed using such multi-ply packaging material, and may be variously decorated or provided with other visual information. Pouch subassembly 200 includes pouch outer blank 210 and pouch inner blank 220. The pouch is assembled from two facing plies of suitable laminated film material. As shown in FIG. 1A, in the initial pre-fabrication state, the outer blank 210 and the inner blank 220 are in the form of at least substantially flat structures (i.e., flat layers of film material).

In the illustrated example, pouch outer blank 210 is devised to have a greater extent than pouch inner blank 220, so that when they are positioned with their fusible surfaces in a facing relationship, an exposed margin of fusible surface is allowed around pouch inner blank 220. Pouch outer blank 210 may, for example, carry branding, imagery, descriptions, or instructions, and may exhibit an ornamental finish owing to a foil or metallized inner ply.

Pouch inner blank 220 has a perimeter that outlines the expected volume of the fluid reservoir, but has a significantly smaller area than outer blank 210 as will be appreciated by viewing FIGS. 1A and 1B. Outer margin 212 of pouch outer blank 210 may be subsequently joined to a further material, owing to the residual exposed surface of fusible polymer. Outer margin 212 is indicated as the area outside the perimeter bonding between the blanks 210, 220 and thus, corresponds to an area or space exterior to pouch inner blank 220.

Three distinct volumetric features are formed by the joining of pouch outer blank 210 and pouch inner blank 220. The joined blanks define anticipated fluid reservoir 230, shown in FIG. 3. In the illustrated application of the invention, the reservoir is circular and is devised to accept a filled volume of 65 ml.

Pouch reservoir neck 232 extends in one direction from the pouch reservoir. The neck provides narrow directional channel so that flow may be induced when, in the use of the completed system, the user imparts pressure to the filled reservoir.

Pouch mouth 234 expands from pouch reservoir neck 232 and provides an opening into which seal coupling 410 may be fitted with a degree of ease prior to the joining of the components by the application of heat (as shown in FIG. 1A, the top edge of the outer blank 210 includes a cutout to accommodate the seal coupling 410). These volumes may optionally be preformed to a three-dimensional shape, but they may also be simply and adequately formed into a volume by the internal pressure against the loose pouch material upon its filling with fluid.

Front panel subassembly 300 includes front panel 310 formed of resilient material. Closed-cell polyethylene foam stock having a thickness of about 1.5 mm has been found to yield a compact, comfortable, and impermeable surface. Front panel 310 is provided with a contour similar to that of pouch outer blank 210, and front panel inner face 312 and front panel outer face 314.

The front panel may carry a series of embossed irrigation channels 316 which ultimately promote the distribution of a dose of fluid over the surface of the front foam panel. In the exploded view in FIG. 1A, it may be seen that front panel outer face 314 also carries embossed fastener recesses 318 that anticipate the mounting strips of hooked, reversible fastening material. The recesses allow for less intrusive mounting of the fastening material.

The embossed irrigation panels may be conveniently formed in the same thermal operation in which front panel 310 and pouch subassembly 200 are welded together. A platen may be applied to melt the perimeter of fusible inner ply of pouch outer blank 210, while at the same time heating and partially and locally compressing the closed cell foam of panel 310. Pouch subassembly 200 and front panel 310 are joined at mitt edge weld 250 in a discontinuous manner such that an opening is left between the pouch and front panel along hand entry 110. Typically, this hand entry point is located along the bottom edge of the joined structure.

Hook fastener strips 320 are cut to length or die-cut to shape and attached to the outer face 314 in a range of locations. In the illustrated embodiment, five hook fastener strips 320 are attached in positions somewhat inset from the edge of front panel 310 and near the extremities of the anticipated disposable pads. The hook fastener strips may be attached, for example, using a pressure-sensitive adhesive or a hot melt adhesive. The assembled pouch and front panel subassemblies are shown in FIG. 2 (in FIG. 2, the complete pump subassembly 400 is not shown but instead, the seal coupling 410 is shown).

It will be appreciated that while, elements 320 are referred to herein as hook fasteners strips and the pad has complementary loop fastener features (generally indicated at 321) (either attached thereto or integral therewith as a result of the type of material the pad is made from), other fasteners can be used instead for elements 320, 321. In FIG. 2, the pad 500 is formed of a material that has loop features and therefore, the regions 321 merely indicate areas of the loop material that mate with hook strips 320. In the embodiment where the pad 500 has separate loop fasteners, such as strips or pads, then the legends 321 represent such strips or pads.

Alternatively, the fasteners 320 can be in the form of snaps or other mechanical fasteners. It being understood that the front panel 310 and the pad 500 have complementary fasteners (e.g., snap parts) to allow for the detachable connection between the two structures. In the present figures, the texture of pad 500 has not been shown for ease of illustration; however, it will be appreciated that pad 500 can be formed of a fabric and can have a loop structure (non-smooth) structure as described herein.

Figure 6:
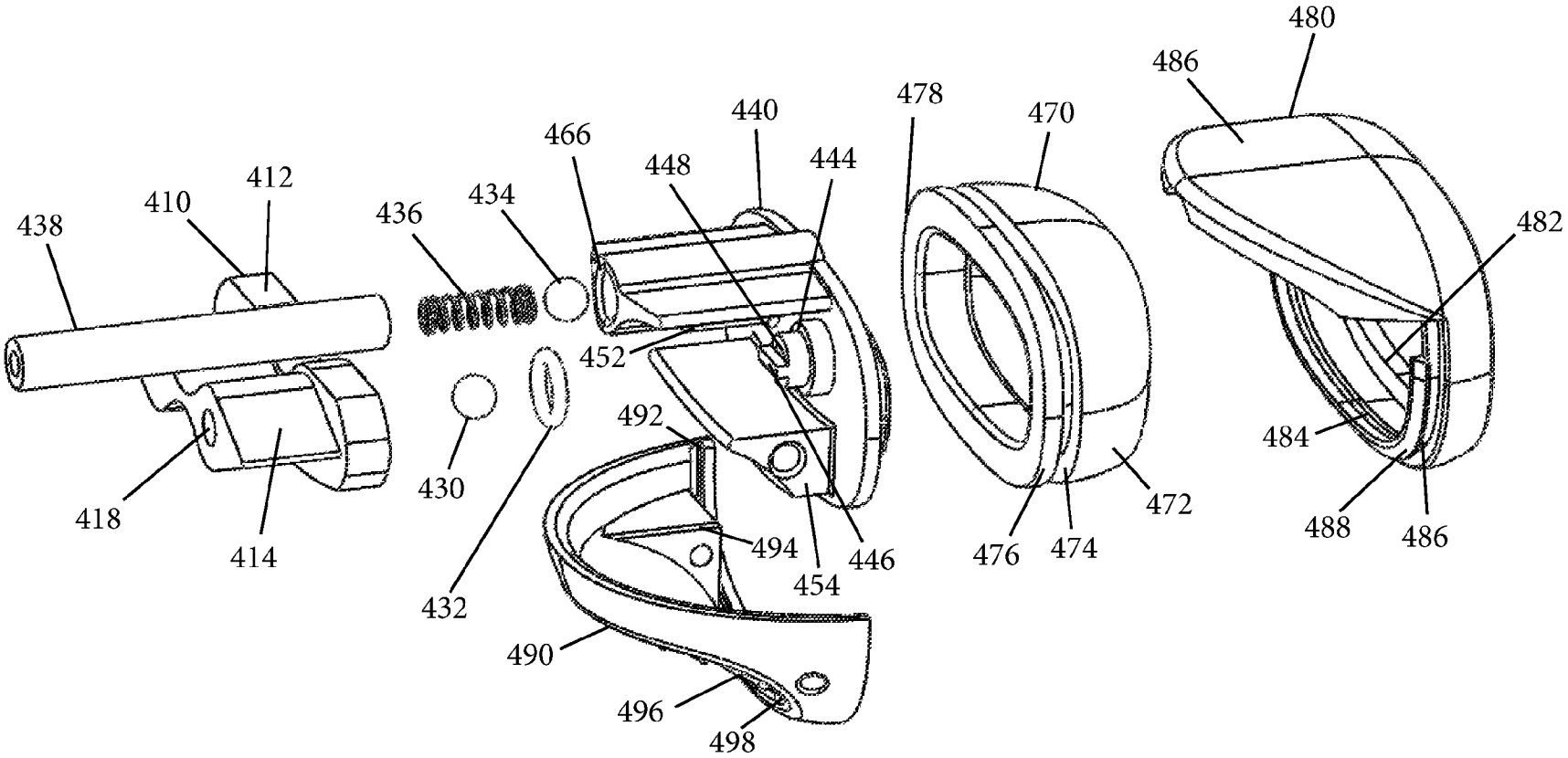
FIG. 6 is an exploded view of an exemplary pump subassembly.
Figure 7:
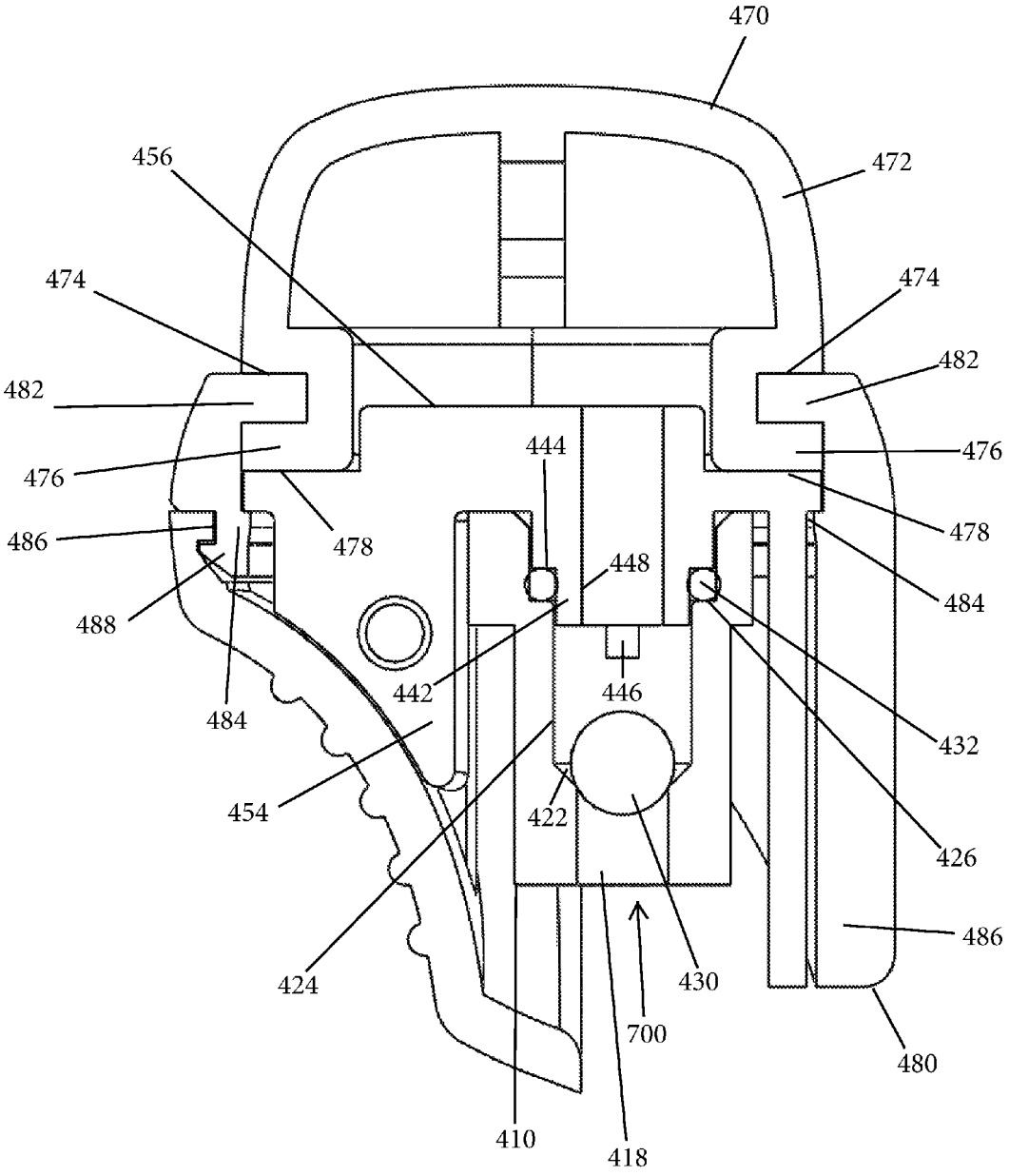
FIG. 7 is one cutaway sectional view of an exemplary pump subassembly, showing details of the inlet check valve.
Figure 8:
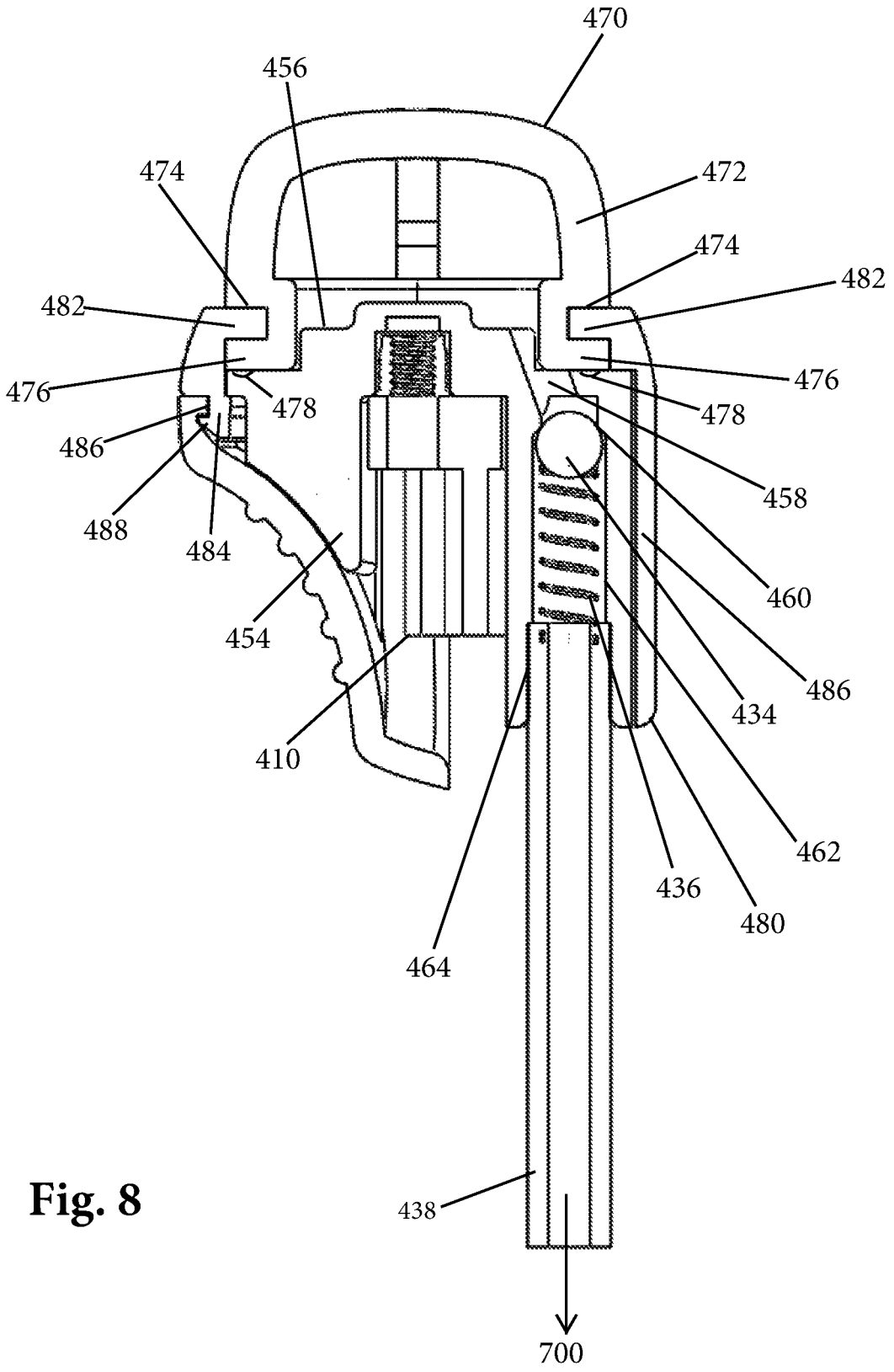
FIG. 8 is another cutaway sectional view of an exemplary pump subassembly, showing details of the discharge check valve.

Fluid is to be transported from the back of the mitt to the front by pump subassembly 400. The details of the pump subassembly are shown in FIGS. 6, 7, and 8. Owing to an integral set of valves, the pump subassembly is able to receive and temporarily trap a metered volume of fluid within an elastic bulb.

When the bulb is compressed by an external action, at least a portion of the trapped volume of fluid will be delivered to the front face of the mitt. In the configuration illustrated embodiment of the invention, fluid is ejected in a direction approximately opposite to that of the induced pumping action. In other words and as described herein, the pump is constructed such that fluid is drawn into the pump from the reservoir by flowing in a first direction and then is ejected from the pump by flowing in a second direction opposite the first direction; however, the first and second flows are at least substantially parallel to one another.

The exploded view of the pump in FIG. 6 illustrates the major components of the pump subassembly. The larger parts of pump subassembly 400, in addition to seal coupling, include pump manifold 440, pump bulb 470, pump housing 480, and pump back cover 490. These parts snap, clamp, or wedge together to form a substantially leak-proof pumping means.

The subassembly also includes a small set of functional elements that are entrapped or otherwise during assembly, including intake check ball 430, intake O-ring 432, discharge check ball 434, and outlet check spring 436. The fluid delivery path provided by the pump subassembly terminates at dispensing tube 438.

In the following description, it should be understood that the pump subassembly, except for seal coupling 410, may be preassembled into a working module that is then snapped into place over the seal coupling after the seal coupling has been welded to the pouch.

Seal coupling 410, pump manifold 440, pump housing 480, and pump back cover 490 may conveniently be injection-molded of suitable polymers. Pump bulb 470 and intake O-ring 432 may be formed of compressible elastic material such as rubber, silicone, or polymeric elastomer. In the current embodiment, a thermoplastic elastomer having a durometer of 60 on the Shore A scale has been found effective.

Outlet check spring 436 may be a metal compression spring made of a suitable ferrous or nonferrous alloy, but may also be variously devised of plastic.

Seal coupling 410 is fashioned so that it may be readily and securely bonded to the outlet of pouch reservoir neck 232 (in other words, the seal coupling is disposed between the two blanks 210, 220 that are bonded to one another). It has been demonstrated that reliable, leak-proof joint may be achieved by thermally sealing pouch material to a compatibly devised coupling. Subsequently, the attached coupling can serve to form a rigid base to which other molded parts may be attached. FIGS. 1A and 1B show this arrangement.

It will be appreciated that the joined blanks 210, 220 (see FIG. 1B) define the reservoir and when the reservoir is filled, the blanks 210, 220 will naturally pucker (expand/protrude) in this region. Thus, from the rear of the assembled product, the outline of the reservoir may be visible. It will be understood that the shape of the reservoir can vary and the generally circular shape that is shown is not limiting.

Molded pouch couplings often exhibit a wedged or tapered edge at either end, so that the pouch layers are gradually parted by the coupling, and so that the parted layers can wrap with sufficient conformity over the coupling ends that no leakage occurs at the location where the two pouch layers are parted. Such couplings are therefore often most commonly widest at their center.

In the invention, such a design was found to be suboptimal, since, within the requirements of the anticipated application, the conventional design inherently results in a relatively thick and intrusive section. During personal cleaning, it is essential that pump subassembly remain clear of the body surface, both for comfort and continuity of operation.

In the invention, the outer aspect of the pump must therefore both optimally have an unobtrusive shape, and ideally outer should have surfaces that readily deflect in the case of inadvertent contact with the user's body. These considerations have been incorporated in the design of the present invention.

For example, the seal coupling is designed to provide a secure connection surface for the pouch, while maintaining a minimal thickness in the dimension perpendicular to the major plane of the mitt. As a uniform design principle in systems where a connector is joined to such a pouch, the length of each side of the sealed pouch connection must correlate with the measured length of the curve along each side of the molded connector.

If the pouch is made to rest in an intermediate flat state, without folds or buckling, the length of the two sides of the neck opening must be substantially the same. For conceptual simplicity, the portion of the connector that extends into the neck of the pouch therefore is generally made to be bilaterally symmetrical about the major plane of the unfilled pouch.

The seal coupling may be fabricated of any effective polymer, however, it may be appreciated that low-density polyethylene has an inherent affinity with materials commonly used for the fusible inner layer of the laminated pouch film stock. The remaining rigid pump components may be formed of polyethylene or other moldable thermoplastic polymer.

Seal coupling 410 includes seal coupling collar 412 from which bilobate coupling extension 414 extends. In view of the foregoing discussion, it may be appreciated that the bilobate sectional profile of seal coupling extension 414 provides the inserted part an especially low profile, owing to the waist at its center, while still conforming to the design constraints cited above.

Furthermore, while the relevant section of the part is shown as being bilaterally symmetrical in two perpendicular axes, it may be appreciated that the two curves that converge at the tapered edges of coupling extension 414 may be freely and electively varied in curvature to optimize the overall compactness, convenience, or comfort of all the elements of the fluid transport system.

It may be appreciated that, in order to conform to the requirement of forming a seal without buckling or folding of the pouch, the two sides of the seal coupling extension must only be equal in total length. The contours of the two sides may therefore depart from one another in local concavity or convexity of curvature, so long as their total length is substantially equal.

The structure and function of the intake components of the pump may be best understood by concurrent reference to FIGS. 6 and 7. The inward direction of fluid flow is indicated by the arrow suggesting motion of fluid 700. In the illustrated example, one lobe of the bilobate coupling extension 414 includes blind alignment hole 416. The second lobe encompasses seal coupling intake port 418. Intake port 418 is a through-hole which allows fluid to exit the neck of pump and enter the pump subassembly. Intake port 418 widens in diameter at intake ball seat bevel 422 to the meet the internal cylindrical surface wider intake ball trap 424, and widens again at coupling O-ring shoulder 426.

Intake check ball 430 has a diameter greater than that of intake port 418 but less than that of intake ball trap 424. During assembly of the pump subassembly, the intake check ball is captured within intake ball trap 424 which is integrally formed in seal coupling 410 and pump manifold intake collar 442 which is integrally formed in pump manifold 440. Pump manifold crossbar 446 divides one open end of pump manifold intake port 448.

The check ball is trapped within the cylindrical intake ball trap 424, but remains loose within it. Manifold intake O-ring 432 is made of elastic material and is held in compression by the assembly of the end face of ball trap 424 against pump manifold intake shoulder 444. This O-ring prevents fluid from escaping at the annular juncture where the intake ball trap joins the manifold intake port.

Movement is stopped at the respective ends of ball trap by ball seat bevel 422 at one end and pump manifold intake crossbar 446 at the other. The crossbar prevents the seating of intake check ball 430 at the end of intake ball trap 424 that is farther from the reservoir.

These assembled elements therefore act to promote biased unidirectional fluid flow, since backflow to the reservoir is checked by the seating of the intake check ball 430 against intake ball seat bevel 422, while fluid flow away from the reservoir is always permitted.

More specifically, forward flow at the intake to the pump bulb volume is always allowed because the diameter of the cylindrical ball trap is larger than the entrapped ball, and because the two, chord-shaped openings that constitute the divided end of pump manifold port 448 are always open, owning to the intentional interference of the crossbar. Fluid in this location is therefore always free to flow around the ball and out through the divided port.

The seal coupling and the pump manifold are also joined where blind alignment hole 416 in the seal coupling receives pump manifold alignment pin 452. The alignment pin and the alignment hole may be devised to form a temporary or effectively permanent frictional fit depending upon the elected materials and elected cooperative draft angles. A pair of flat pump manifold cover catches 454 extends integrally from the body of the manifold.

The structure and function of the pump and discharge elements of the pump may be best understood by concurrent reference to the exploded view in FIG. 6 and the sectional view of FIG. 8. The outward direction of fluid flow is indicated by the arrow suggesting motion of fluid 700. It has been shown that he side of pump manifold 440 nearer to the reservoir includes the features described above. The side of the manifold farther from the fluid reservoir includes additional structures relating to the pumping means of the fluid supply system, and which operate cooperatively with flexible pump bulb 470. The pump bulb may be made of rubber, elastomers, polymers, or any other material that is sufficiently elastic that it may be manually deformed to displace an enclosed volume of fluid.

In inset perimeter region of pump manifold platform 456 provides a bearing surface for elastic pump bulb 470. Pump manifold discharge channel 458 angles out through the manifold platform to join beveled pump manifold discharge ball seat 460, which becomes geometrically contiguous with cylindrical discharge ball trap 462. A coaxial, annular step is formed at pump manifold tube receptacle 464.

The discharge ball trap is braced by pump manifold fairing 466. In the assembly of the pump parts, discharge check ball 434 is installed in discharge ball trap 462. Discharge check spring 436 is brought to bear against discharge check ball 434. Dispensing tube 438 is then inserted into the full depth of pump manifold tube receptacle 464, in such a way that at the spring is held in a fixed state of partial compression against the discharge check ball. Discharge check ball 434 thereby bears against discharge ball seat 460 and maintains a fluid gate in a normally closed state.

Pump bulb 470 includes pump bulb body 472, which is designed to enclose a predetermined volume of fluid drawn from the reservoir. Pump bulb rim channel 474 and pump bulb rim flange 476 are formed about the perimeter of the elastic bulb. Pump bulb rim gasket 478 promotes sealing of the relatively elastic bulb against the relatively rigid pump manifold. The gasket can be located along the bottom of the body 472 and have an annular shape. It can occupy the entire bottom edge surface or a part thereof.

Pump manifold platform 456 has planar, parallel stepped surfaces so to accommodate the mating of the manifold with the pump bulb. As may be understood from the drawings, the elastic pump bulb is intimately secured against pump manifold platform 456 through the compressive clamping action of pump housing 480. During assembly, the elastic pump bulb is momentarily deformed so that pump housing rim 482 is fitted inside conformally dimensioned bulb rim channel 474.

The seating of the pump manifold to the pump housing by the holding action of housing internal snap rim 484 compresses bulb rim flange 476 and the smaller-scale pump bulb rim gasket 478 against pump manifold platform 456 to collectively form a leak-proof seal. The enclosed volume between pump manifold platform 456 and the inner surface of pump bulb 470 in the completed pump subassembly is 2.2 ml.

Pump housing cowl 486 forms an integral cover section on one side of the pump housing, while pump housing external rim groove 486 and external snap rim 488 follow the remainder of the perimeter of pump housing rim 482.

Pump housing external rim 486 fits into pump back cover rim groove 492 formed on one edge of pump back cover 490. Pump back cover snap fittings 494 engage with flat pump manifold catches 454. Pump back over finger rest 496 is externally concave and may electively include pump cover grip surface 498. Pump cover grip surface 498 may include parallel ribbing or other surface relief.

When the pump is assembled as described about the completed mitt assembly 100, dispensing tube 438 inherently rests within a region of embossed irrigation channel 316. This conscientious design recesses the tube relative to the more elevated face regions of front panel outer face 314.

The foregoing description details the structure and mode of assembly of the pump subassembly. It may be seen that the pump design as formed according to the depicted embodiment invention provides a highly compact, enclosed fluid dispensing system that is free of sharp edges and free of any sort of abrupt surface obstructions.

More comprehensively, the completed mitt assembly includes a fluid reservoir, a dosing pump, and an impermeable, resilient front panel. The foam front panel, with its attached hook fasteners, is devised to receive a succession of disposable fibrous pads.

Figure 5:
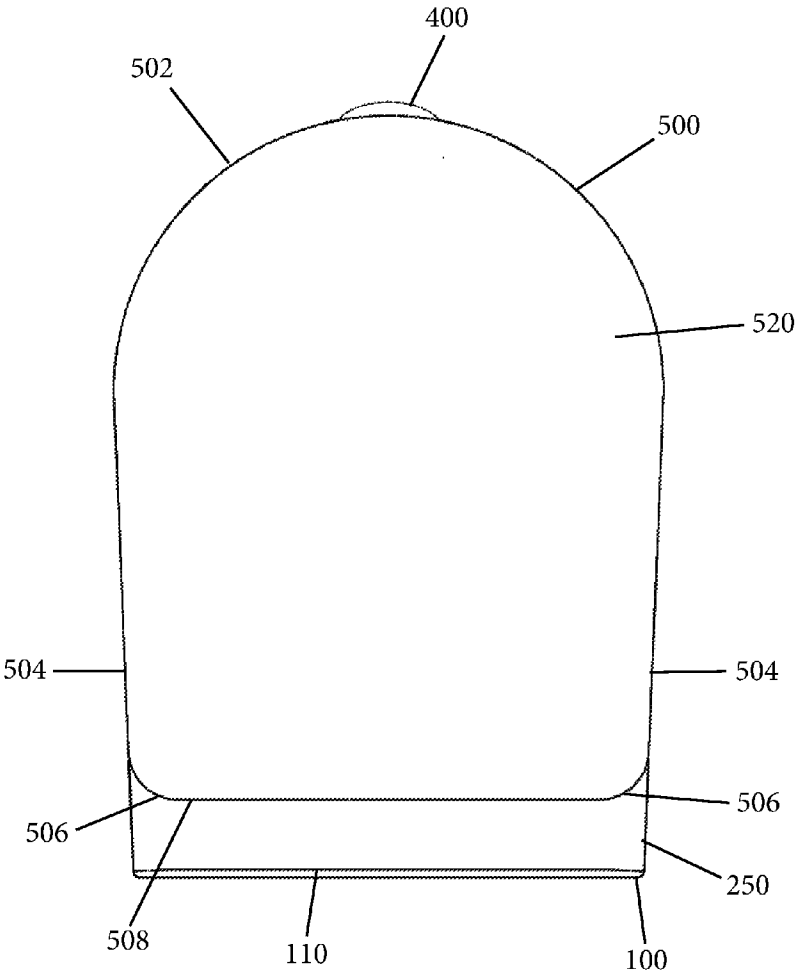
FIG. 5 is a plan view of the completed mitt assembly with a pad applied.

The pad subassembly is expressly shown in FIG. 2, FIG. 5, and FIG. 11. Exemplary pad subassembly 500 includes a two-ply composition of nonwoven material. In the illustrated embodiments, the pads are dimensioned to substantially coincide with the outermost margin of the mitt assembly over most of its perimeter. A wider inset is provided along the straight edge near hand entry 110, so that the pads can be fitted to the mitt such that part of the mitt is left exposed in the wrist area. The difference in length and resulting exposed area may have a dimension of about 25 mm. The pad outer contour includes large radius 502, side edges 504, corner radii 506, and straight hand entry edge 508.

Suitable layered pad fabrics may be purchased from converters as webs in which two or more plies have been previously combined by the converter. For example, pad inner ply 510 may usefully be a non-apertured spunlace having a basis weight of 135 474 gsm. Such a spunlace may be a blend of rayon and PET fibers composed of 50% Rayon and 50% PET. This spunlace material has been found to inherently act as the loop component in a hook-and-loop reversible fastening system. In the present application, the looped spunlace fabric can be made to securely engage with the hook structures on hook fastener strips 320.

Pad outer ply 520 is the fibrous surface ultimately applied to the surface being cleaned, such as the surface of the user's body. A suitable material for outer ply may be described as a finished apertured spunlace. Such an apertured spunlace material may accordingly be a blend of PET and cellulosic fibers composed of 50% PET and 50% cellulose.

It may be appreciated that a diversity of nonwoven materials and blends is available in a range of combinations, according, for example, to the cost, to the fluid used, or to the anticipated cleaning task. For example, pad inner ply 510 may alternately be made of a spun lace nonwoven composed of 80% Tencel (Lenzing Fibers Inc., NY, N.Y., USA) and 20% polyester.

Pad outer ply 520 can alternately be made of polyethylene needlepunch. The outer layer of the pad may include materials outside the range of those cited above, including non-fibrous material such as fluid permeable open-cell foams, or woven fabric.

Figure 9:
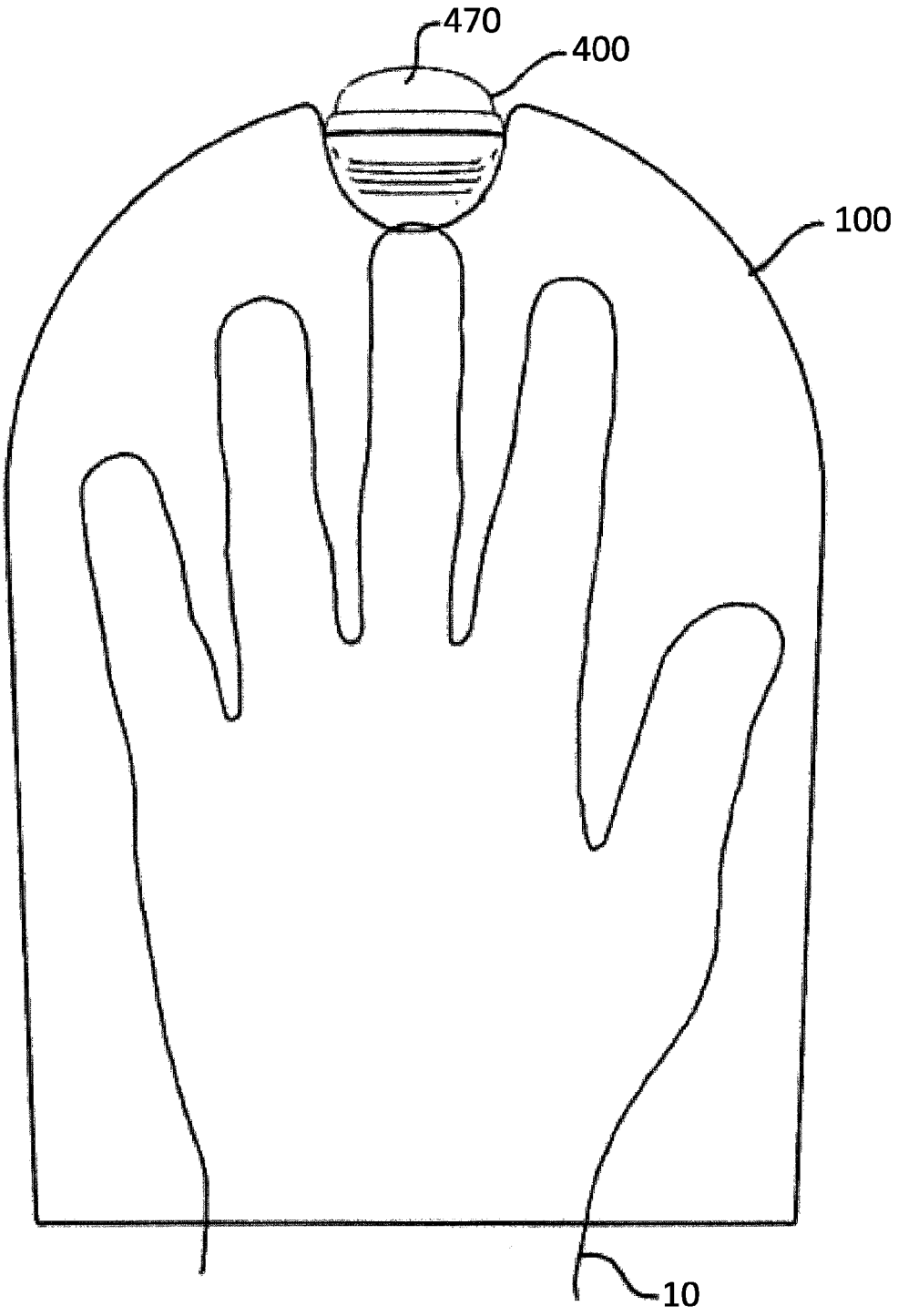
FIG. 9 shows the position of the hand during use of the cleaning mitt.

FIG. 9 shows the position of the hand during use of the cleaning mitt. It may be appreciated by reference to this figure the ease with which displacement may be introduced by the hand to pump bulb 410 by any opposing physical resistance.

Figure 10:
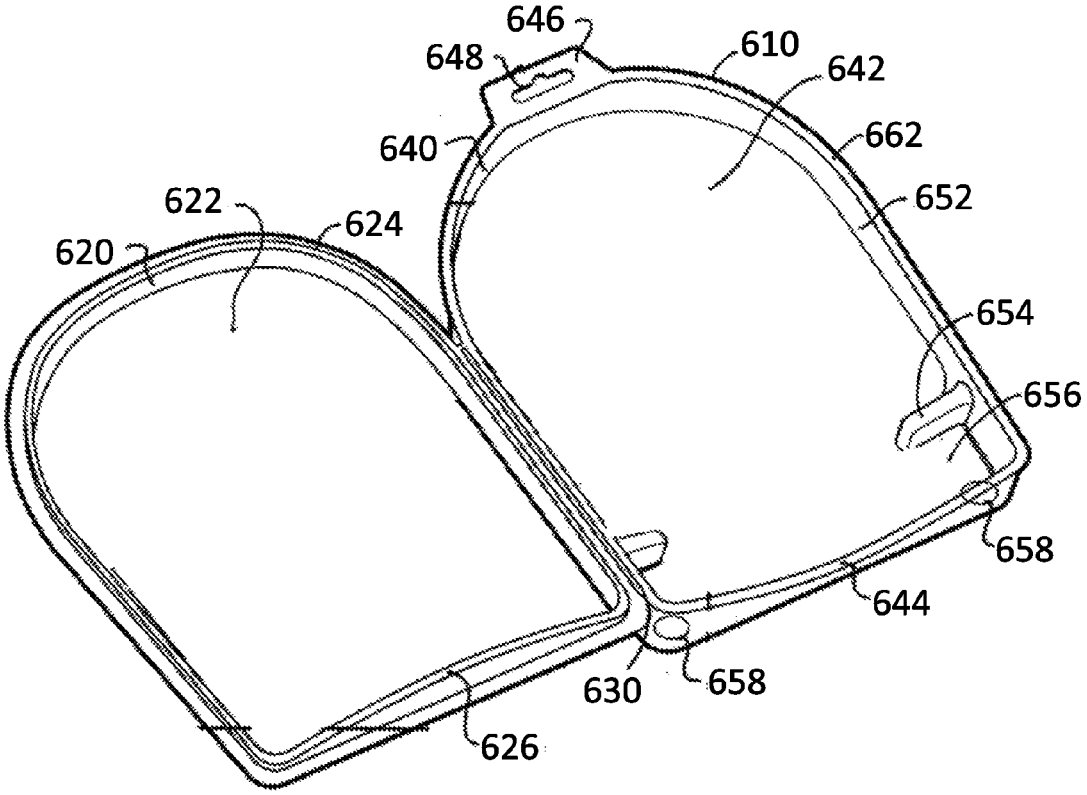
FIG. 10 is a first perspective view of the hinged enclosure formed according to the invention, showing the empty enclosure.

The details of a compatibly designed enclosure and mounting system are shown in FIGS. 10, 11, and 12. Kit enclosure subassembly 600 provides a convenient container for a plurality of pads, but is also conscientiously devised to aid in the mounting of a fresh pad when the mitt remains mounted on a hand. The enclosure also serves to discourage accidental deformation of the pump bulb, and thereby precludes premature release of the enclosed fluid.

Accordingly, the enclosure is of a slightly greater dimension that that of the mitt, and includes a more limited interior well that corresponds to the size of a stack of disposable pads. The illustrated embodiment of the enclosure is dimensioned to hold sixteen pads. A layer of interleaving may be included in the stack so that it may intermittently be repositioned as impermeable separator 810 between clean and soiled pads.

Referring particularly to the general properties of the empty enclosure shown in FIG. 10, kit enclosed shell 610 may be made of thermoformable transparent PET having a thickness of approximately 0.5 mm. Kit enclosure hinged shell 610 includes front shell 620 which is connected along one edge via live hinge 630 to rear shell 640.

Front shell 620 includes convex display window 622, front shell snap flange 624, and convex cover protrusion 626. Convex cover protrusion 626 extends from one edge of the container, and geometrically correlates with the wrist entry side of the correspondingly shaped mitt.

The rear shell includes internally concave pad conforming surface 642, concave wrist recess 644. The rear shell also includes hang tab 646 having elongate sombrero perforation 648 for mounting on a merchandising display. Rear shell 640 also includes pad tray wall 652, which may be devised to partially surround and contain the assembled mitt and a predetermined number of disposable pads. Pad alignment guides 654 prevent undesirable movement of the pads during storage, transport, or mounting. Secondary well 656 reflects the difference in longitudinal dimension between the pads and the mitt.

Pad conforming surface 642 is internally concave and therefore externally convex. Stabilization feet 658 may be made to extend from the back of the enclosure so that at least two feet occupy a geometrically coplanar surface. The stabilization feet may be geometrically continuous or geometrically discontinuous with pad conforming surface 642, and still be coplanar. When so formed, the stabilization feet will prevent the enclosure from rocking when placed on a flat surface, for example, during mounting of a pad on the mitt.

Rear shell snap flange 662 and front shell snap flange 624 are designed to have complementary tapered structures about a meaningful proportion of their perimeters so that they may secure engagement with one another, so that they may be pressed together to make a reversible closure.

The case can be fitted with diverse labels inserts, and instructional devices.

The edge joints where the flanges meet when the hinge is closed may electively be sealed using a perforated tear-off perimeter strip, or with a breakaway shrink-wrapped seal. In a packaged state, the enclosure may include welds or seams that deter or indicate tampering, but are not necessary for reliable closures subsequent to the first use of the product.

Fluid 700 may be introduced via intake port 418 in seal coupling 410 after the coupling is welded to the pouch, and the balance of the pump parts assembled around it to form a leak-proof seal. Alternately, an area of the perimeter of the reservoir may be left unsealed, forming a secondary channel having fluid access to the as yet unfilled reservoir. This secondary channel may be permanently sealed after filling.

In any case, the system of the invention can optionally include a frangible sanitary seal that is breached upon the first use of the system. For example, a foil seal may be formed to cover the end of the tube receptacle 464 on the molded pump manifold, and the seal breached by the insertion of dispensing tube 438.

A temporary seal may also be located over the undivided end pump manifold intake port 448 where it exits onto pump manifold platform 456, and may be breached by external pressure upon the filled reservoir upon first use. Such a temporary seal may be devised to be deliberately frangible by making a foil seal sufficiently thin, by applying the seal with relatively a weak adhesive bond, or by scoring or partially perforating an otherwise sound physical barrier. Other locations for analogous features and equivalent operations may be readily envisioned.

Once the pouch is filled with a suitable fluid and the pump assembly completed, the other components may be collected for packaging. The sequence of packaging and use of the system of the invention may be understood by particular reference to FIGS. 10, 11, and 12. The loading of the enclosure may begin with impermeable separator 810 being placed directly upon concave pad conforming surface 642. Impermeable separator 810 may compatibly correspond to the shape of the anticipated pads. When set in this initial location, the impermeable separator may usefully carry graphics which are visible from the back of the container.

As indicated in FIG. 11, a stack of pads is then placed upon impermeable separator 810 and within pad tray wall 652. Pad alignment guides 654 assist in seating these materials. The mitt assembly carrying the filled pouch is then placed on top of the stack of pads, as shown in FIG. 12. In FIG. 12, the reservoir is shown for illustration purposes and to indicate its location in the mitt; however, as discussed, from the rear, the reservoir outline is only visible in the form of a protruding portion (puckered)) of the outer blank. Primary printed insert 910 may be applied to the inside of convex display window 622 of front shell 620, and may cover part or all of the window. Secondary printed insert 920 may be located in secondary well 656. As long as a transparent material is used for the enclosure, both inserts may practically carry printing on each side. For purpose of illustration, the insert 910 has been removed from FIG. 12 but is seen in FIG. 11 and it will be understood it can be present in FIG. 12.

In a proposed original packing state, an aligned stack of pads is held within the walls surrounding the concave conforming surface 642. This arrangement allows the mitt to be readily aligned with a stored pad of similar profile, while also encouraging the pad to acquire a somewhat convex shape as it is mounted. Once all the required components are in place, front shell snap flange 624 may be engaged with.

In the following exemplary operation of the completed embodiment of the invention, any factory seal on the enclosure is first removed. The case is set on a flat surface so that stabilization feet 658 and the apex of the enclosure near the hang tab 646 rest stably on the flat surface. A user then opens the enclosure and removes the mitt that carries the sealed fluid reservoir.

As indicated by the illustration in FIG. 9, user's hand 10 is first placed intuitively via hand entry 110 into the pocket of the mitt. The external face of the front panel is pressed against the stack of pads lying over concave conforming surface 642 inside the enclosure. Concave wrist recess 644 and the space between pad alignment guides 654 collectively provide relief for the user's wrist.

The face of the mitt is placed within the structural perimeter of the enclosure and against the top pad so that the hooked features on the face of the mitt naturally align and engage with the loop features on the topmost side of the top pad. Pressure applied by the user in this circumstance causes a reversible coupling (lamination) to occur between the mitt and a pad while their layers are being conformed against a curved surface. The relatively rigid concave conforming surface inherently imparts a corresponding convexity to the layers of the relatively flexible cleaning mitt and pad as the complementary hook and loop elements engage.

The kit enclosed shell 610 can include a protruding portion at the top edge thereof that receives the protruding displaceable interface (bulb) of the mitt. In this manner, this protruding portion or arcuate formed cavity of the shell 610 can serve as a locating feature and serve to locate and retain the mitt in place within the shell 610 since the rounded bulb 470 seats within this rounded cavity.

The completed assembly comprising the mitt and pad will therefore retain a degree of convexity after the cleaning mitt assembly is removed from the enclosure. Because the pads are free to move against one another, this convexity will occur even when a full stack of pads is stored in the well.

Once the pad is mounted in this manner, the fluid dispensing system will have an outlet at a location between the mitt face and the attached replaceable pad. The user may pump a metered amount of fluid 700 from the reservoir to the pad by successively depressing and releasing the resilient pump bulb. The specific operation of the pump bulb will be understood based on the foregoing description of the components and functionality of the pump mechanism and the accompanying figures.

The bulb may be compressed using the hand opposite to that in the mitt, or the pump bulb may be pressed directly against any surface having sufficient mechanical resistance. The outer face of the dampened pad may then be used to clean the user's body, or any other suitable surface.

A soiled pad can be removed from the mitt, and either discarded or returned to the container. The separator may be located between the used pad or pads and any remaining unused pads, so that the clean, unused pads are shielded from soiling or contamination. The soiled pads may thus be reserved within the container for later disposal, for example, in remote and protected geographical areas where appropriate trash receptacles are unavailable.

It may be appreciated that, for readiness and for the convenience of the user, that the kit may be provided with a pad already mounted upon the mitt face. In this case, the above procedure would be followed only as the first pad is removed and replaced.

Diverse implementations of the invention are anticipated beyond the range of the embodiments herein illustrated and described. For example, the fluid contained in the reservoir need not be a cleansing, nor include only cleansing agents.

Exemplary fluid formulations may therefore be derived from diverse materials commonly used for cleansing, cosmetic, or medicinal purposes, and may include component materials such as water, soaps, detergents, surfactants, solvents, aromatics, oils, waxes, emollients, lotions, lubricants, salves, creams, balms, liniments, ointments, disinfectants, antibiotics, treatments, coatings, emulsions, stabilizers, thickeners, abrasives, foaming agents, reagents, insect repellents, insecticides, indicators, stains or colorants. Thus, different types of fluids can be stored in the reservoir of the present dispenser (applicator) and these fluids can have different viscosities and other different fluid properties. In addition, the fluid can include other additives/agents, such as perfumes/fragrances, disinfectants, anti-microbial agents, etc.

A fluid formulation suitable for use within the invention may also include macroscopically or microscopically encapsulated formulations carried within or along with such components, so that the encapsulated material or materials are only released by the subsequent actions of the user. It may be understood that the diversity of the potential range of fluid materials that may be made available to a user is a convenient and versatile aspect of the invention.

Although the preceding description describes system in which the pads are described as disposable, it should be understood that this is only intended to describe the convenience and utility of a particular embodiment. It is expected that pads may be designed in anticipation of repeated use so that they can be rinsed, washed, sterilized, or autoclaved.

In general, any visible surface may be provided with graphics, and such graphics may be provided by diverse methods, including printing, molding, coating, embossing, labeling, or any other perceptible means. Graphics may include branding, images, ornamentations, descriptions of use, instructions, ingredients, pricing, promotions, or any other functional or decorative content.

In yet another embodiment, the present invention can be implemented to include a refillable reservoir. The mitt described herein can be thought of as being an applicator for applying fluid to a target surface, such as the skin. As described herein, the applicator (mitt) can be constructed so as to be disposable after a number of uses and more particularly, the applicator can be used until the reservoir runs dry. Alternatively, in a refillable version, the applicator is constructed such that it includes a refill port that is in fluid communication with the reservoir. A user can refill the reservoir following certain steps. For example, the refill port can include a one way valve and a fluid delivery conduit (e.g., a fluid tube) can be inserted into the refill port to deliver fluid into the reservoir for refilling thereof.

A sanitizing fluid can be used between refills to ensure a clean reservoir.

For a number of fluids, the present product is preferably constructed as a non-refillable product as described herein with reference to the figures.

It will also be understood that one or more of the parts can include indicia, such as a brand name or logo or other printed indicia. More specifically, the pads can be formed in different colors and include logos, such as a sports logo or the like. In this case, the user can personalize the product. Alternatively, the rear blank 210 can include indicia as mentioned above and thus, a sports logo or corporate brand name can be provided along this surface.

The use of materials and implements formed according to the invention should not be limited by foregoing description, but rather by the extent of the appended claims.

What is claimed is:

1. A portable fluid dispensing device for mounting upon a human hand comprising:

a hand-held applicator that includes a pocket that is configured to receive one hand of a user, the pocket partitioning the hand-held applicator into a rear portion and a front portion;

a fluid reservoir formed in the rear portion for holding a fluid that is to be dispensed; wherein the rear portion includes a first layer and a second layer that are fluidly sealed to one another such that the fluid reservoir is directly defined by and located between the first and second layers, the second layer being a separate layer from the first layer and further defining one layer and face of the pocket and being contactable by the one hand of the user, wherein a footprint of the second layer is less than a footprint of the first layer;

at least one fluid dispensing outlet formed in the front portion and in selective fluid communication with the fluid reservoir for selectively dispensing the fluid through the at least one fluid dispensing outlet; and a fluid dispensing mechanism in fluid communication with the fluid reservoir and the at least one fluid dispensing outlet and being configured to selectively deliver the fluid from the fluid reservoir to the at least one fluid dispensing outlet through which the fluid is dispensed along the front portion.

2. The portable fluid dispensing device of claim 1, wherein the first and second layers comprise flexible films and the second layer is sealingly bonded to the first layer around a peripheral edge of the second layer.

3. The portable fluid dispensing device of claim 2, wherein each of the first and second layers includes a fluid reservoir section, a reservoir neck section and a mouth section, the reservoir neck section being disposed between the fluid reservoir section and the mouth section.

4. The portable fluid dispensing device of claim 2, wherein the first and second layers differ in dimension, and wherein relative dimensions of the first and second layers differ such that a margin of material comprising a single layer remains after formation of the fluid reservoir section, the margin being sealingly bonded to the front portion along the margin.

5. The portable fluid dispensing device of claim 1, wherein the pocket is defined by an outer face of the rear portion and an inner face of the front portion, the at least one fluid dispensing outlet is being formed along an outer face of the front portion.

6. The portable fluid dispensing device of claim 5, wherein the at least one fluid dispensing outlet comprises at least one recessed channel formed in the outer face of the front portion in which the fluid can flow.

7. The portable fluid dispensing device of claim 6, wherein the at least one fluid dispensing outlet comprises a plurality of recessed channels formed in the outer face of the front portion.

8. The portable fluid dispensing device of claim 7, wherein each of the plurality of recessed channels is a closed ended channel.

9. The portable fluid dispensing device of claim 5, wherein the inner face of the front portion is a smooth face and the at least one fluid dispensing outlet being confined to the outer face of the front portion.

10. The portable fluid dispensing device of claim 1, further including a pad configured to be detachably coupled to an outer face of the front portion such that the pad overlies the at least one dispensing outlet, the pad being formed of a fluid permeable material to allow the fluid that is dispensed from the at least one dispensing outlet to wet the pad.

11. The portable fluid dispensing device of claim 10, wherein the outer face of the front portion includes a first coupling member and the pad includes a second coupling member that is complementary to the first coupling member to provide the detachable coupling between the pad and the front portion.

12. The portable fluid dispensing device of claim 11, wherein the first and second coupling members comprise hook and loop materials.

13. The portable fluid dispensing device of claim 1, wherein the fluid reservoir comprises a sealed reservoir that is not accessible by the user and is not refillable.

14. The portable fluid dispensing device of claim 1, wherein the fluid dispensing mechanism comprises a hand operated pump that draws fluid from the fluid reservoir and delivers the fluid to the at least one fluid dispensing outlet.

15. The portable fluid dispensing device of claim 14, wherein the pump comprises an elastic bulb pump that includes a deformable bulb that when operated draws a metered volume of fluid into the bulb and then subsequently discharges the metered volume through the at least one dispensing outlet.

16. The portable fluid dispensing device of claim 15, wherein the pump includes an inlet that is in selective communication with the fluid reservoir and a dispensing tube that is in selective communication with the at least one fluid dispensing outlet.

17. The portable fluid dispensing device of claim 16, further including a first valve in fluid communication with the inlet and openable when negative pressure exists in a hollow interior of the bulb and the fluid is drawn into a hollow interior and a second valve in fluid communication with the dispensing tube and openable when positive pressure is applied to the bulb after the fluid has been drawn into the hollow interior of the bulb.

18. The portable fluid dispensing device of claim 17, wherein the first and second valves comprise one-way check valves.

19. The portable fluid dispensing device claim 1, wherein the fluid dispensing mechanism is disposed along a top edge of each of the front portion and the rear portion and fluidly connects the fluid reservoir to the at least one dispensing outlet.

20. The portable fluid dispensing device of claim 1, wherein the fluid dispensing mechanism is configured to be repeatedly activated by application of mechanical force to a displaceable interface that has an internal volume capable of intermittently receiving a dose of the fluid from the reservoir, the fluid dispensing mechanism further including a connector that is shaped such that it has a waist indented from at least one side of the connector such that the waist defines first and second lobes, the first lobe being fluidly connected to the reservoir and the second lobe being fluidly connected to the at least one fluid dispensing outlet.

21. The portable fluid dispensing device of claim 20, further including a manifold that provides a fluid outlet path from the internal volume to the at least one fluid dispensing outlet and wherein the manifold is fitted at least in part with the waist wherein the connector is bilobate in form and the first lobe includes an intake port capable of providing fluid communication between the reservoir and the internal volume.

22. A portable fluid dispensing device for mounting upon a human hand comprising:

a hand-held applicator that includes a pocket that is configured to receive one hand of a user, the pocket partitioning the hand-held applicator into a rear portion and a front portion; a fluid reservoir formed in the rear portion for holding a fluid that is to be dispensed;

at least one fluid dispensing outlet formed in the front portion and in selective fluid communication with the fluid reservoir for selectively dispensing the fluid through the at least one fluid dispensing outlet; and a fluid dispensing mechanism in fluid communication with the fluid reservoir and the at least one fluid dispensing outlet and being configured to selectively deliver the fluid from the fluid reservoir to the at least one fluid dispensing outlet through which the fluid is dispensed, the fluid dispensing mechanism including a dispensing tube that has a distal end that defines the fluid dispensing outlet, wherein the distal end of the dispensing tube is disposed along an outer surface of the front portion at a location spaced internally from a peripheral edge of the front portion for delivering the fluid centrally with respect to the front portion.

23. A portable fluid dispensing device for mounting upon a human hand comprising:

a hand-held applicator that includes a pocket that is configured to receive one hand of a user, the pocket partitioning the hand-held applicator into a rear portion and a front portion; a fluid reservoir formed in the rear portion for holding a fluid that is to be dispensed, wherein the rear portion includes an outer layer and an inner layer that are fluidly sealed to one another such that the fluid reservoir is defined between the outer and inner layers, wherein the front portion is only defined by a single layer that is directly attached to the outer layer but free of attachment to the inner layer;

at least one fluid dispensing outlet formed in the front portion and in selective fluid communication with the fluid reservoir for selectively dispensing the fluid through the at least one fluid dispensing outlet; and a fluid dispensing mechanism in fluid communication with the fluid reservoir and the at least one fluid dispensing outlet and being configured to selectively deliver the fluid from the fluid reservoir to the at least one fluid dispensing outlet through which the fluid is dispensed.

* * * * *